US005394226A

United States Patent [19]

Beardsley et al.

[11] Patent Number: 5,394,226

[45] Date of Patent: Feb. 28, 1995

[54] METHOD FOR REDUCING HIGH QUALITY ELECTROPHOTOGRAPHIC IMAGES

[75] Inventors: Gary S. Beardsley, Morgan Hill; Lawrence B. Schein, San Jose, both of Calif.

[73] Assignee: International Business Machines Corporation, Armonk, N.Y.

[21] Appl. No.: 982,236

[22] Filed: Nov. 25, 1992

Related U.S. Application Data

[63] Continuation of Ser. No. 778,436, Oct. 16, 1991, abandoned.

[51] Int. Cl.[6] ..... G03G 15/14

[52] U.S. Cl. ..... 355/277; 355/77; 355/210; 355/271

[58] Field of Search ..... 355/200, 245, 271, 277, 355/279, 210, 290, 77; 430/120, 31, 99, 126

[56] References Cited

U.S. PATENT DOCUMENTS

| | | | |
|---|---|---|---|
| 4,183,658 | 1/1980 | Winthaegen | 355/277 X |
| 4,207,101 | 6/1980 | Vola et al. | 355/271 X |
| 4,254,206 | 3/1981 | Draai et al. | 430/126 |
| 4,531,825 | 7/1985 | Miwa et al. | 355/271 X |
| 4,531,827 | 7/1985 | Tarumi et al. | 355/210 |
| 4,585,319 | 4/1986 | Okamoto et al. | 355/271 X |
| 4,737,434 | 4/1988 | Gruber et al. | 430/120 |
| 4,796,048 | 1/1989 | Bean | 355/277 |
| 4,841,328 | 6/1989 | Takeuchi et al. | 430/31 X |
| 4,927,727 | 4/1990 | Rimai et al. | 430/99 |
| 4,959,434 | 9/1990 | Biglione et al. | 526/342 |
| 4,968,578 | 11/1990 | Light et al. | 430/126 |
| 4,992,304 | 2/1991 | Titterington | 427/64 |
| 5,073,796 | 12/1991 | Suzuki et al. | 355/210 |
| 5,084,735 | 1/1992 | Rimai et al. | 355/271 |

OTHER PUBLICATIONS

M. Ogasawara and M. Kimura, "High Quality Toner Image Transfer in Electrophotographic Printing", *Fujitsu Sci. Tech. J.*, 24, 3, pp. 235-241, Sep., 1988.

*Primary Examiner*—A. T. Grimley
*Assistant Examiner*—Sandra L. Brasé
*Attorney, Agent, or Firm*—Perman & Green

[57] ABSTRACT

It has been determined that the two systems that contribute to edge raggedness in producing electrophotographic images are the development and transfer systems. Conventional development systems cause wrong sign toner to be attracted to the edges of the formed characters. Conventional transfer systems utilize electrostatic transfer whereby large electric fields are applied across a small air gap. In order to reduce edge raggedness, wrong sign toner is eliminated during the development step by using tribolelectrically charged toner and electrostatic transfer is replaced with non-electrostatic transfer techniques, either thermal or pressure, or combinations thereof. In either event, the resistivity of the intermediate surface is preferably $10^{10}$ ohm-cm or lower. Significantly improved electrophotographic images result.

13 Claims, 8 Drawing Sheets

METHOD FOR REDUCING HIGH QUALITY ELECTROPHOTOGRAPHIC IMAGES

This is a continuation of application Ser. No. 07/778,436, filed on Oct. 16, 1991, now abandoned.

BACKGROUND OF THE INVENTION

1. Field of the Invention

The present invention relates generally to electrophotographic copying and printing and, more particularly, to unique techniques for substantially reducing edge raggedness of printed characters.

2. Description of the Invention

While the electrophotographic copying and printing industry has grown enormously in the past 30 years, and the quality of the images have significantly improved during this time frame, its images can still be readily recognized as inferior to offset printed images.

Technical innovation in electrophotography has made possible several advances in copy quality. First, by changing the development system from cascade to insulative magnetic brush development in the early 1970's, it became possible to copy and print solid blacks. Second, the blackness of the images was increased while the background was decreased by introducing the conductive magnetic brush development system. Yet close inspection of images made today with electrophotography reveal two obvious defects as compared to images made by offset printing techniques which can be obtained in any magazine, book, or advertisement. First, laser electrophotographic printers have stairstepping along diagonal lines. Second, for both electrophotographic printers and copiers, the images are "fuzzy".

The stairstepping that occurs in laser electrophotographic printers results from the finite positioning of the laser beam. It can be corrected by increasing the resolution of the laser beam, that is, providing more dots per inch, or by allowing the software to turn on the laser beam at subpixel positions. Both techniques are now available commercially.

The fuzziness apparent on all output from electrophotographic printers and copiers is a well-recognized defect. Various "solutions" based on changing the photoreceptor and the paper have been suggested. The inventors, however, have looked elsewhere for a solution.

To allow laser-printers to effectively compete with offset printing, the quality of the laser printer output must be made comparable to the quality of offset printing. The major unresolved quality difference today between these two printing technologies is the "fuzziness" of the images.

The technical term for "fuzziness" is edge raggedness. There are various ways to measure edge raggedness. The one chosen for purposes of the invention includes the steps of (1) capturing the image in computer memory using a CCD camera enabling its display on a television screen, (2) identifying the edge using an algorithm which locates where the black-white transition occurs, (3) defining a least squares straight line through the edge, and (4) calculating the mean square deviation of the actual edge from the best straight line.

Using this definition of edge raggedness, it has been found that offset images have an edge raggedness of about 5 μm, while electrophotographic images from systems with magnetic brush development have an edge raggedness of 17 μm and systems using monocomponent development have an edge raggedness of 12 μm.

These differences are easily perceived by customers as an increased "fuzziness" around characters. With a low power magnifying glass, the eye can perceive toner scattered around the character, which is clearly associated with the character. The technical problem is therefore to identify the source(s) of the toner scatter and to eliminate them. As far as is known, no one has attempted a systematic study of this problem. Only a systematic analysis of the problem will allow the identification of the contributing subsystems, their mechanisms, and appropriate solutions. The inventors have addressed this problem and have found that the sources of the edge raggedness are two subsystems in the electrophotographic system: the development subsystem and the transfer subsystem.

All of the subsystems in electrophotography could in principal also contribute to edge raggedness, and perhaps do under various circumstances. For example, surface conductivity on the photoreceptor can lead to charges in the latent image spreading out in time, perhaps leading to ill-defined edges. Or, during fusing, the unfused toner could be disturbed before it is fused into a melted image. However, evidence for these effects have not been found by the inventors. Of the six subsystems in electrophotography, namely, charging, exposure, development, transfer, fusing, and cleaning, the ones found by the inventors to contribute to the edge raggedness are the development and transfer subsystems.

It was in light of the foregoing state of the art that the present invention has been conceived and is now reduced to practice.

SUMMARY OF THE INVENTION

In order to reduce edge raggedness in electrophotographic images, one needs to identify and fix those subsystems of electrophotography that contribute to the edge raggedness. The two systems which contribute to edge raggedness are the development and transfer systems. The development system contributes to edge raggedness because wrong sign toner is attracted to the edges of the formed characters. Electrostatic transfer contributes to edge raggedness because, as the paper is separated from the photoreceptor, air breakdown occurs, scattering the toner. Therefore, to minimize edge raggedness, wrong sign toner is eliminated from the development system and electrostatic transfer is replaced with non-electrostatic transfer techniques such as pressure and thermal transfer.

The development step contributes to edge raggedness by placing wrong sign toner adjacent to the actual image. Around every image there are fringe electric fields. Field lines associated with these fields begin in the photoreceptor ground plane, curve into the air adjacent to a character being formed, and then end up on the charges of the latent image in the character. The electric field lines pull right sign toner to the image, but they also pull wrong sign toner to regions adjacent to the character. Some of this wrong sign toner transfers with the image and appears as toner scatter around it. Wrong sign toner is the first source of edge raggedness. It is corrected by eliminating wrong sign toner from the development system.

When wrong sign toner is eliminated from the development system, the toner image on the photoreceptor is virtually perfect, that is, it has an edge raggedness equivalent to offset printing, 5 μm. This number is due to the finite size of toner particles. However, after electrostatic transfer, the edge raggedness is increased to 12–15 μm. Therefore the transfer system is also a cause of edge raggedness.

The mechanism by which the electrostatic transfer system increases edge raggedness is air breakdown which occurs when large electric fields are imposed across a small air gap. Ionized air molecules are accelerated in the electric field which ionize other molecules, leading to an avalanche effect. This is the source of lighting in the atmosphere. In the present situation, as the paper with toner is separated from the photoreceptor, the charge placed on the back of the paper creates an electric field in the air gap between the paper (with unfused toner on it) and the photoreceptor. The fields required to achieve transfer are sufficiently large to initiate air breakdown. This breakdown causes the toner to scatter away from the original position.

Therefore the second necessary step to minimizing edge raggedness is to replace electrostatic transfer with non-electrostatic transfer techniques. Both pressure and thermal transfer techniques are well-known in the literature. In this disclosure, pressure transfer to an intermediate surface is suggested and then thermal transfer to paper.

In summary, the sources of edge raggedness are wrong sign toner from the development subsystem and air breakdown due to electrostatic transfer. Edge raggedness equivalent to offset printing can be achieved by combining two known concepts: (1) eliminate the wrong sign toner from the development system and (2) eliminate electrostatic transfer.

This invention, then, is a successful combination not previously proposed of two existing concepts which leads to improved quality images.

First, the concept that reducing wrong sign toner leads to improvement in electrophotography is well known. Wrong sign toner is known to be waste toner, since it ends up on the background areas, is rejected by electrostatic transfer, and is cleaned off. Further, it has been shown to be indirectly responsible for background on copies and print. Background is defined as toner particles unintentionally placed in nonimage areas. Third, various authors, including the present inventors, have pointed out that low charged toner becomes airborne in the machine thereby causing reliability problems. However, nowhere in print, to the inventors' knowledge, is it stated that wrong sign toner contributes to edge raggedness with these types of toners.

Second, non-electrostatic transfer also has been suggested previously for various reasons. For example, it is well known that conductive toner cannot be transferred electrostatically because at high relative humidities the conductivity of paper causes the toner charge, but not the toner, to transfer to paper. Therefore, pressure transfer and thermal transfer have both been used with these systems. However, no system exists today that uses both pressure and thermal transfer with normal insulating, triboelectrically charged toner, and, nowhere in print, to the knowledge of the inventors, is it stated that electrostatic transfer contributes to edge raggedness with these types of toners.

In summation, according to the invention, in order to reduce edge raggedness, wrong sign toner is eliminated during the development step by using tribolelectrically charged toner and non-electrostatic transfer techniques are utilized, either thermal or pressure, or combinations thereof. In either event, the resistivity of the intermediate surface is preferably $10^{10}$ ohm-cm or lower. By so doing, significantly improved electrophotographic images result.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings, which are incorporated in and constitute a part of this invention, illustrate various embodiments of the invention and, together with the description, serve to explain the principles Of the invention in general terms. Like numerals refer to like parts throughout the disclosure.

BRIEF DESCRIPTION OF THE DRAWINGS

FIGS. 5BB, 6BB, 7BB, and 8BB all depict, at a magnification of 21×, printed characters performed using known techniques;

DETAILED DESCRIPTION OF THE PREFERRED EMBODIMENTS

Figure 1A:
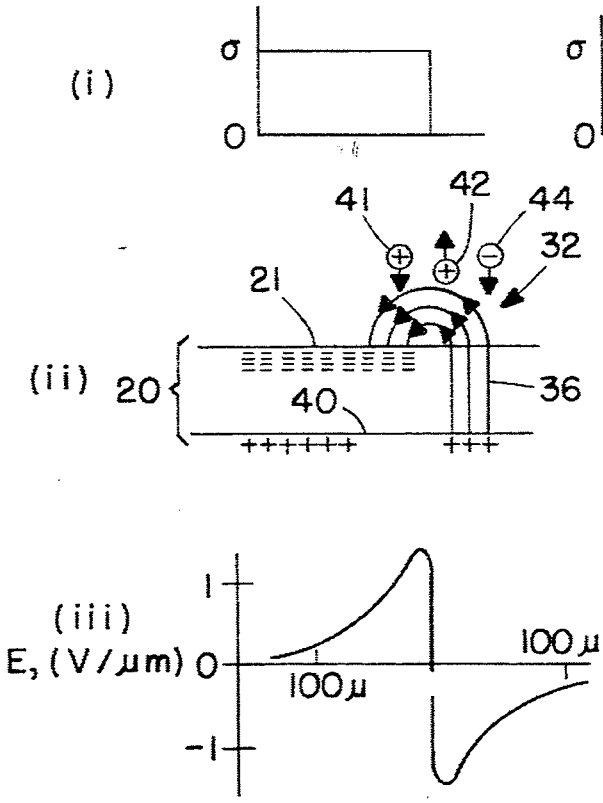
FIG. 1A is a diagrammatic representation of printed character development of an ideal latent image.
Figure 1B:
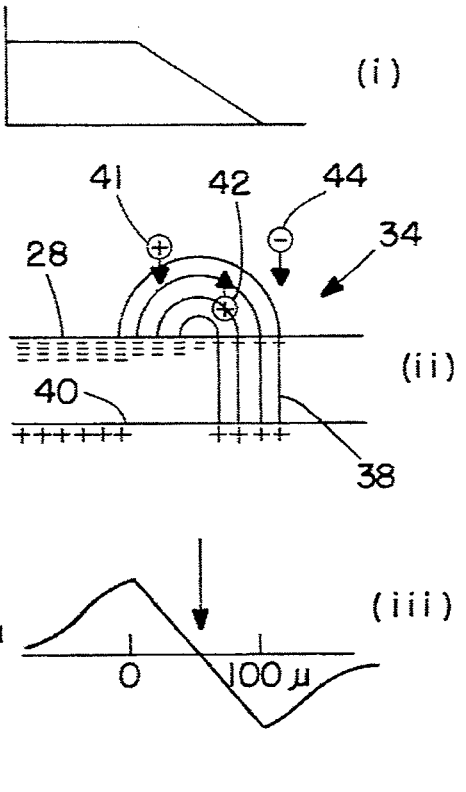
FIG. 1B is a diagrammatic representation of printed character development of an actual latent image.

Turn now to the drawings and, initially, to FIG. 1 which graphically presents the latent image and its field lines for an ideal (FIG. 1A) character 21 and an actual (FIG. 1B) character 28 in which the charge per unit area ($\sigma$) on the photoreceptor 20 decreases to zero over a finite distance. As previously stated, around every image there are fringe electric fields 32, 34 as depicted in FIGS. 1A (ii) and 1B (ii). Viewing FIG. 1A (ii) field lines 36 associated with the electric field 32 begin in a ground plane 40 of a suitable photoreceptor 20, curve into the air adjacent to the latent image, then end up on the charges of the latent image in the character 21. Similarly, viewing FIG. 1B (ii), field lines 38 associated with the electric field 34 begin in the photoreceptor ground plane 40, curve into the air adjacent to the latent image and then end up on the charges of the latent image in the character 28. The electric field lines 36 (FIG. 1A) (ii)) pull right sign toner 41 to the image and push right sign toner 42 away from the regions adjacent to the latent image. They also pull wrong sign toner 44 to regions adjacent to the character. There is a similar occurrence depicted in FIG. 1B (ii). As previously noted, wrong sign toner is the first source of edge raggedness and is substantially reduced by eliminating wrong sign toner from the development system. FIG. 1B (iii) and FIG. 1B (iii) depict, respectively, the electrostatic field strength adjacent the edge of each of the characters 21, 28. As can be clearly seen, for both the ideal and the actual edge, the electric field changes sign in the vicinity of the latent image.

Figure 2A:
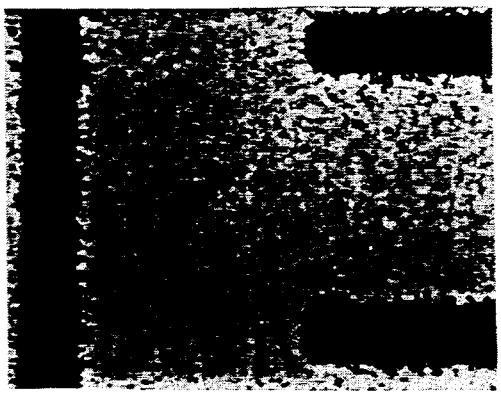
FIG. 2A is a photomicrograph which depicts a portion of a developed latent image formed utilizing prior art techniques.
Figure 2B:
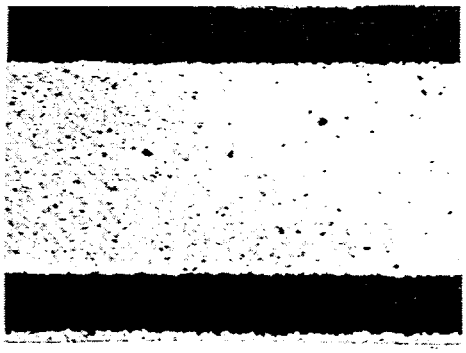
PRIOR ART FIG. 2B.
FIG. 2B is a photomicrograph, similar to that of FIG. 2A, depicting a developed latent image formed in accordance with the invention.

One can determine whether wrong sign toner is eliminated by inspecting the toner image on the photoreceptor prior to transfer. FIG. 2A shows images made with a development system with and FIG. 2B shows images made without wrong sign toner. It is clear that without wrong sign toner, the edge is much more clearly defined, only having a "roughness" caused by the finite size of toner particles. This edge has an edge raggedness of 5 μm. Most development systems today have wrong sign toner; an estimate indicates that about 10% of the toner is wrong sign.

Wrong sign toner can be eliminated at least two ways. First, the triboelectric characteristics of the toner and carrier, if present, can be made sufficiently uniform and different from each other that the probability of making wrong sign toner is minimized. This was the technique used to obtain the images shown in FIG. 2B. The toner chosen was IBM 3825 toner, which includes a charge control agent. The carrier chosen was from that utilized in conjunction with the IBM 6670 printer. It is teflon based and therefore very low on the triboelectric series. This choice resulted from a search for a toner with little wrong sign toner. Empirical techniques suggest that this mix has at least five times less wrong sign toner than normal mixes.

A second technique for eliminating wrong sign toner is to use the knowledge that the wrong sign toner is usually low charged. By putting magnetic material into the toner in conjunction with suitable placement of magnetic material in the development zone, the magnetic fields can be used to pull the wrong sign, low charged toner back into the development system. This technique appears to be serendipitously used in the state-of-the-art Hewlett Packard IIp printer, which has low edge raggedness after development, although high edge raggedness occurs after electrostatic transfer. Experiments have been performed with the Hewlett Packard IIp printer, replacing that printer's transfer system with non-electrostatic transfer systems and have obtained low edge raggedness equal to offset printing.

Figure 3:
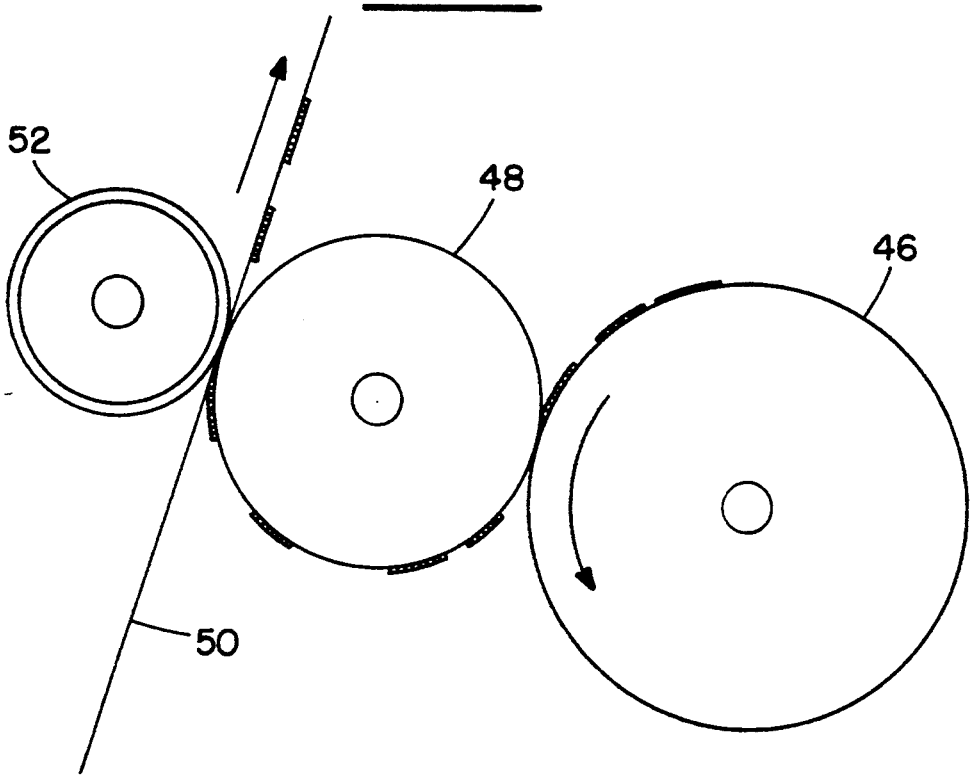
FIG. 3 diagrammatically depicts the step of transferring the developed image to a receiving surface by other than electrostatic means.

According to the invention, electrostatic transfer is replaced with some combination of pressure and thermal transfer. One possible embodiment for a compact single color printer is shown in FIG. 3. In this embodiment, pressure transfer is done from a photoreceptor 46 to an intermediate drum 48 or, alternatively, a belt. Then thermal transfer is done to suitably advancing paper 50 whose temperature can be raised by a suitable fuser roller 52 to bond or fuse the toner onto the paper. The choice of a drum or belt configuration and the decision whether to raise the temperature to accomplish simultaneous fuse during the thermal transfer to paper are determined by the cooling requirements of the intermediate surface. That is, it must be cooled after the thermal transfer step so that when it re-contacts the photoreceptor, its temperature is sufficiently low that it does not destroy the mechanical or electrical characteristics of the photoreceptor.

Figure 4A:
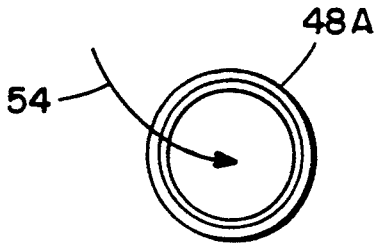
FIGS. 4A, 4B, 4C, and 4D diagrammatically present a variety of constructions, FIGS. 5A, 6A, 7A, and 8A all depict, at a magnification of 48.5×, printed characters achieved using the techniques of the present invention.
Figure 4B:
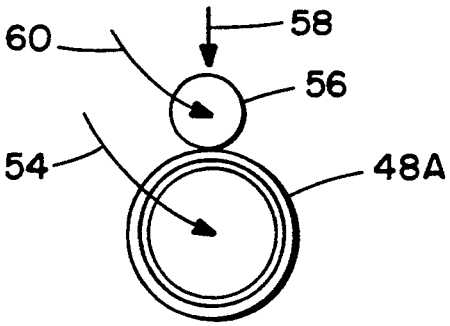

Clearly there is an engineering trade off to be made in the choice of the intermediate surface. An intermediate drum can be made to work if sufficient cooling is provided using techniques such as air flow, cooling rollers or cooling belts in contact with the intermediate roller, cooling fins, and the like. As seen diagrammatically in FIG. 4A, an intermediate drum 48A may be hollow enabling air flow represented by an arrow 54 through its interior for cooling purposes. In FIG. 4B, a cooling roll 56 may be provided in rolling engagement with the intermediate drum 48A for the purpose of drawing heat away from the intermediate drum. In this instance, the cooling roll 56 would be biased against the drum 48A as indicated by an arrow 58. Additionally, cooling air represented by arrows 54 and 60 may be applied to the interior of both the drum 48 and the cooling roll 56 to provide still further cooling benefits.

Figure 4C:
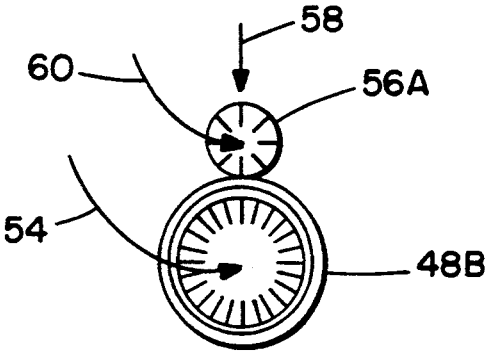

The arrangement in FIG. 4C is similar to that of FIG. 4B. An intermediate drum 48B and a cooling roll 56A are both provided with cooling fins to increase their cooling capability.

Figure 4D:
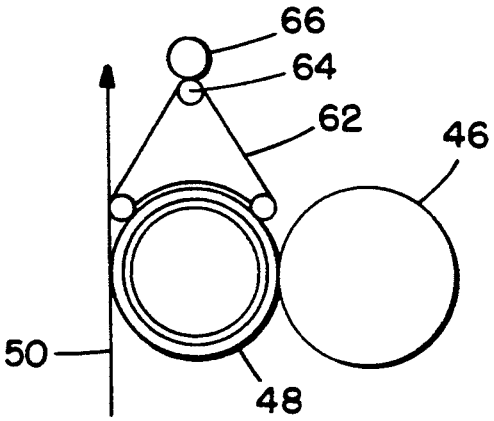

In FIG. 4D, cooling of the intermediate drum 48 is provided by means of a cooling belt 62 guided by rolls 64 so as to contact the outer surface of the drum 48. An additional cooling roll 66 may also be provided in engagement with the cooling belt 62 for still additional cooling effect. An intermediate belt, because it could be designed with a thinner substrate and because of its increased surface area, may be easier to cool. However, a belt requires extra drive rollers and potentially would be larger and more costly. The heat to accomplish the thermal fuse can be applied either to the back of the paper (as shown in FIG. 3) or to the toner on the intermediate roll prior to its entering the transfer nip with, for example, quartz lamps.

The surface characteristics of the intermediate surface are important for this application. It should be conductive enough so that it does not build up charge upon contact with other surface such as the photoreceptor. A semi-conductive material for the intermediate roll is necessary. Our experiments performed with insulating rubbers of various types always resulted in high charge buildup on the rubber surface. At pressures necessary for sufficient toner to transfer from the photoreceptor to the rubber, after just two revolutions, the rubber surface had charged to approximately 3000 volts, far beyond Paschen's curve for air breakdown (about 600–800 volts for such a configuration). Since air breakdown is a primary cause of edge raggedness, the charge on the rubber surface must be constantly reduced to prevent occurrence. The most efficient method is a semi-conductive surface to drain off the charge. It is estimated that resistivities of the intermediate surface of $10^{10}$ ohm-cm or lower are sufficient.

Further, it has been found that pressure transfer requires the surface to have a certain a amount of roughness. A roughness of 0.5 μm measured using a profilometer gives the best results. Also, the material should be soft, so that during the pressure transfer, the material conforms to the toner particles, increasing the area of contact which facilitates the pressure transfer. A durometer of 37 shore A (ASTM test #D2240-86) permits pressure transfer with 95% efficiency. Another requirement on this surface is that it be possible to do the thermal transfer to paper. The thermal transfer, in which the toner is simultaneously fused to paper, requires raising the toner above its glass transition temperature by about 10 deg. C. The roller material must be capable of withstanding temperatures which in some applications may reach approximately 150 deg. C.

Figure 5B:
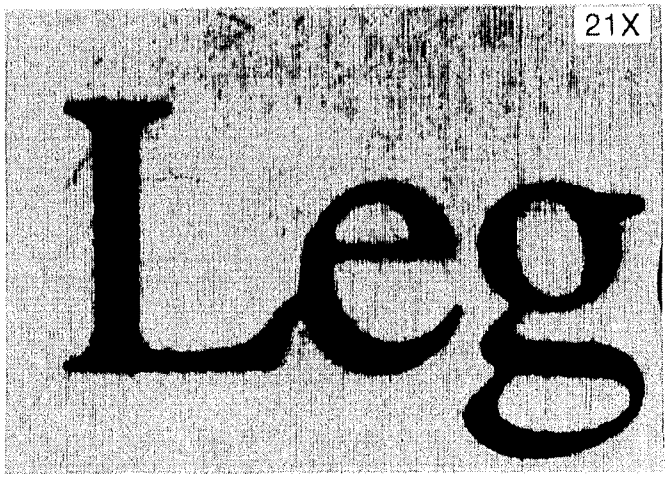
FIG. 5BB. PRIOR ART
FIGS. 5B, 6B, 7B, and 8B all depict, at a magnification of 48.5×, printed characters performed using known techniques.
Figure 5A:
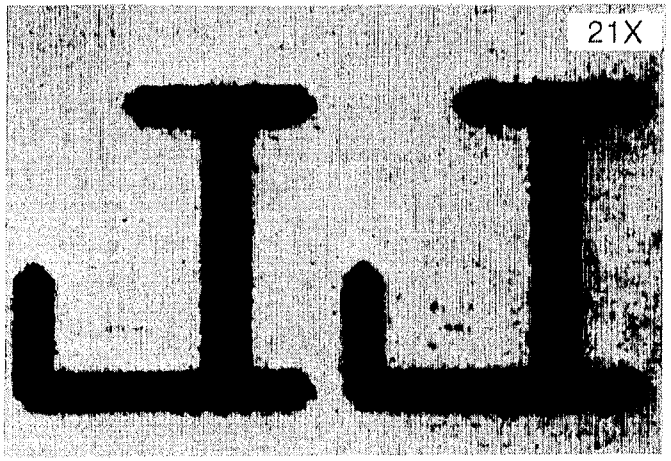
FIGS. 5AA, 6AA, 7AA, and 8AA all depict, at a magnification of 21×, printed characters achieved using the techniques of the present invention.
Figure 5B:
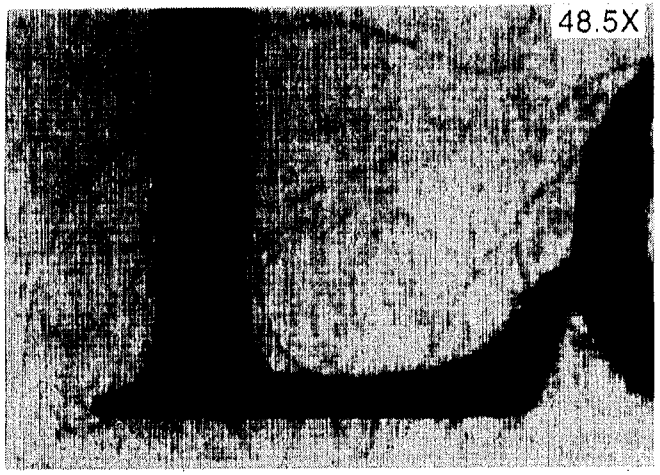
FIG. 5B. PRIOR ART
Figure 5A:
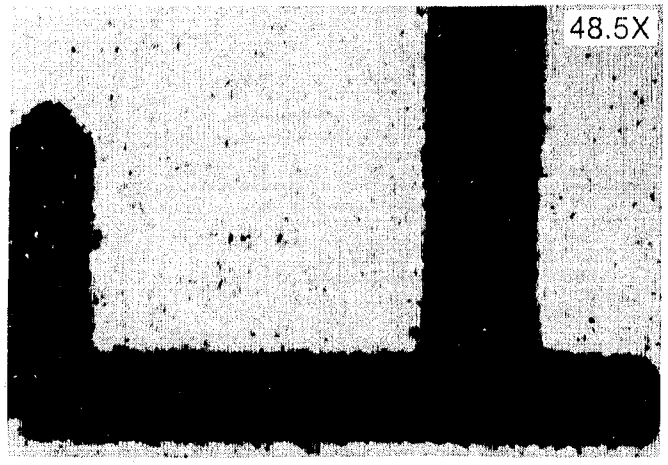

A material system which satisfies all of the above requirements is 20 microns of urethane coated onto $\frac{1}{4}$ inch of nitrile rubber with the top surface treated to obtain the required roughness with either sand-blasting or sanding. Experiments done with this intermediate roller combined with the Hewlett Packard IIp development system produce edge raggedness on paper of 5.5 $\mu$m, equivalent to that of offset printing. Shown in FIGS. 5A and 5AA are results according to the invention at two magnifications (48.5×and 21×, respectively) as compared to images from National Geographic Magazine (edge raggedness 5 $\mu$m) shown in FIGS. 5B and 5BB which represent high quality offset printing. Clearly, by eye, the edge raggedness of FIG. 5A and 5AA is equivalent to that of FIGS. 5B and 5BB.

Figure 6B:
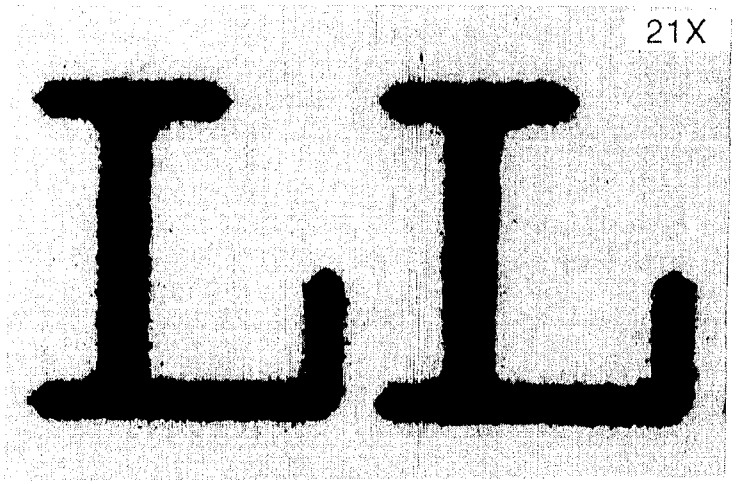
FIG. 6BB. PRIOR ART
Figure 6A:
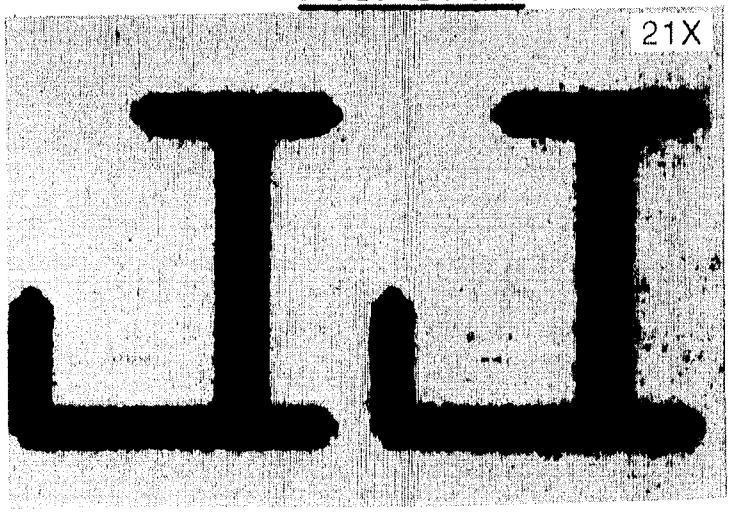
Figure 6B:
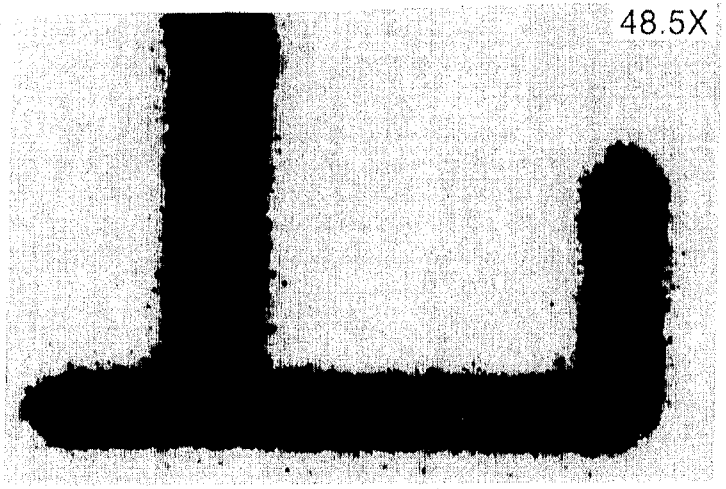
FIG. 6B. PRIOR ART
Figure 6A:
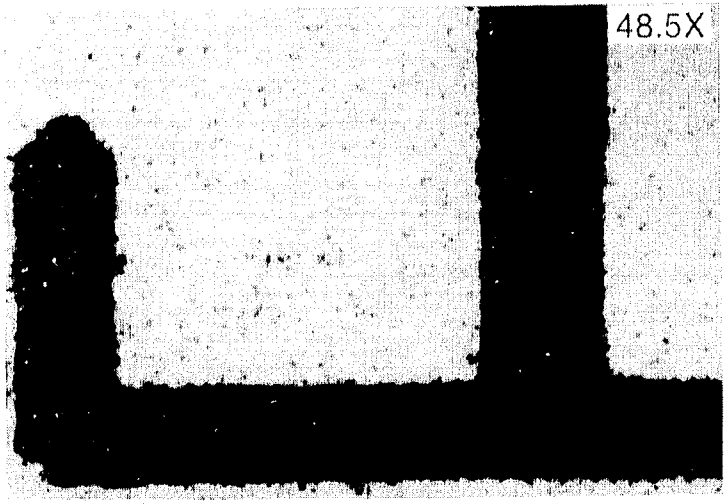

Shown in FIGS. 6A and 6AA are the results according to the invention compared to the Hewlett Packard Laserjet IIp (FIGS. 6B and 6BB with an edge raggedness of 12 $\mu$m which represents high quality electrophotographic output. Clearly the latter image is less desirable.

Figure 7B:
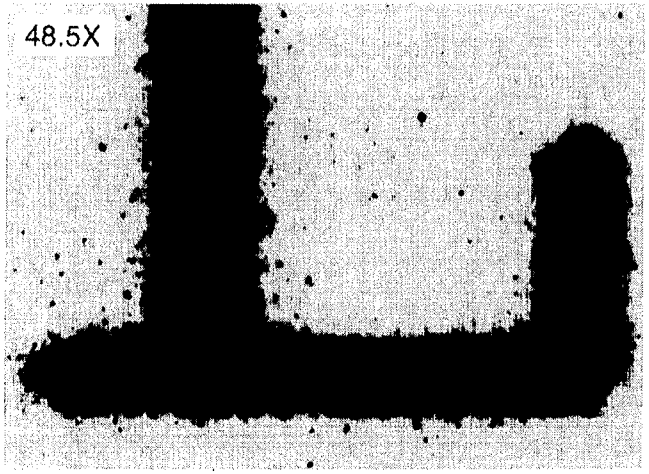
FIG. 7B. PRIOR ART
Figure 7B:
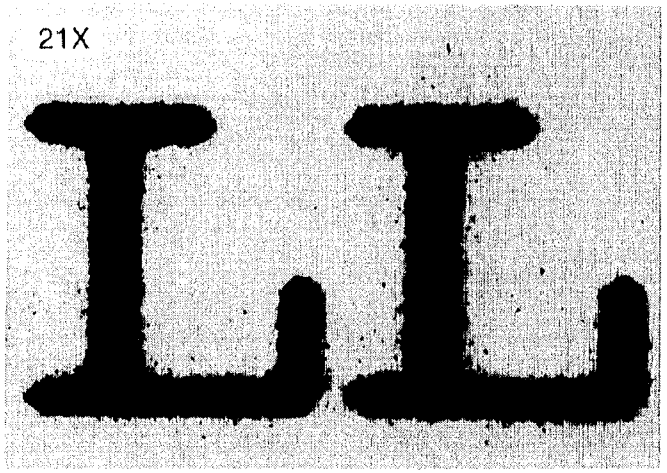
FIG. 7BB. PRIOR ART
Figure 7A:
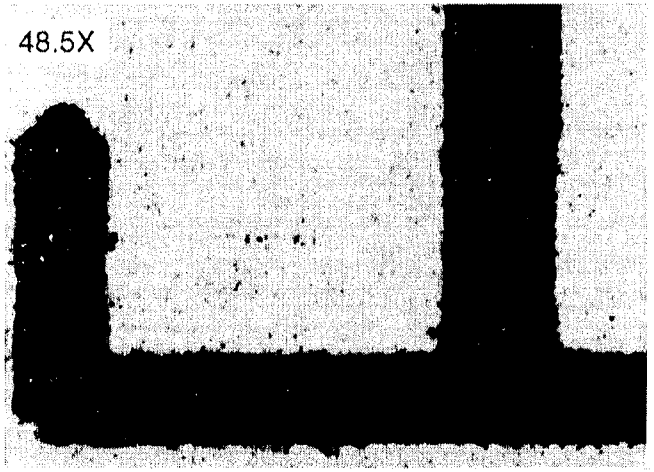
Figure 7A:
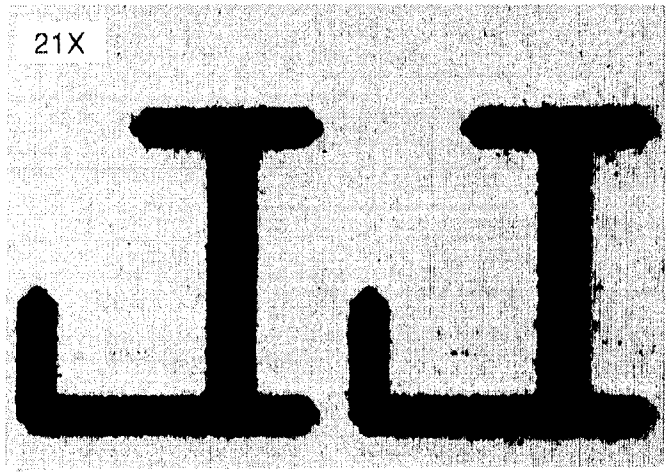
Figure 8B:
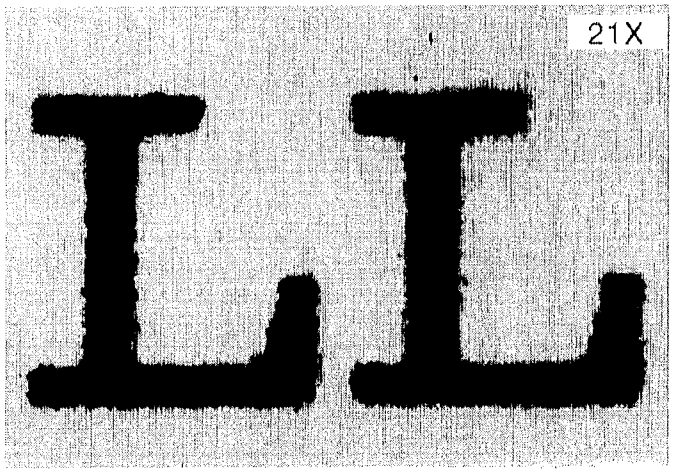
FIG. 8BB. PRIOR ART
Figure 8A:
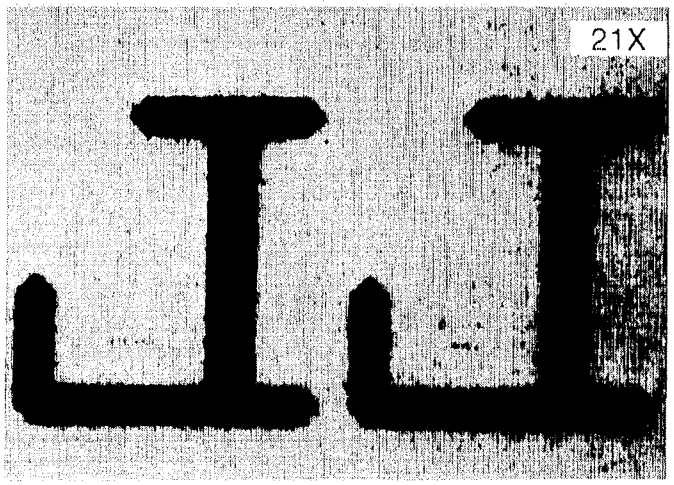
Figure 8B:
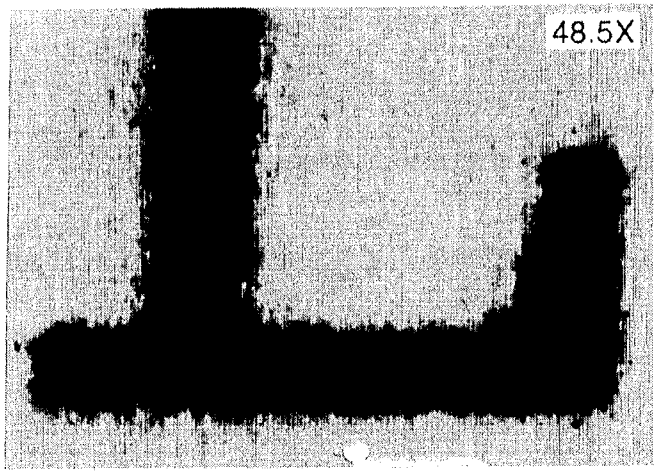
FIG. 8B. PRIOR ART
Figure 8A:
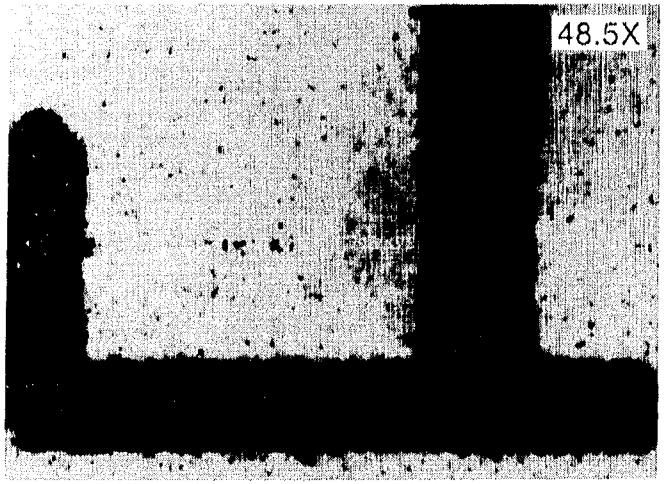

Shown in FIGS. 7A, 7AA and 8A, 8AA are results according to the invention compared to the Hewlett Packard Laserjet III (FIG. 7B, 7BB) and the IBM 4019 (FIGS. 8B, 8BB). Clearly, again, characters printed utilizing the teachings of the invention have dramatically sharper edges.

Figure 9B:
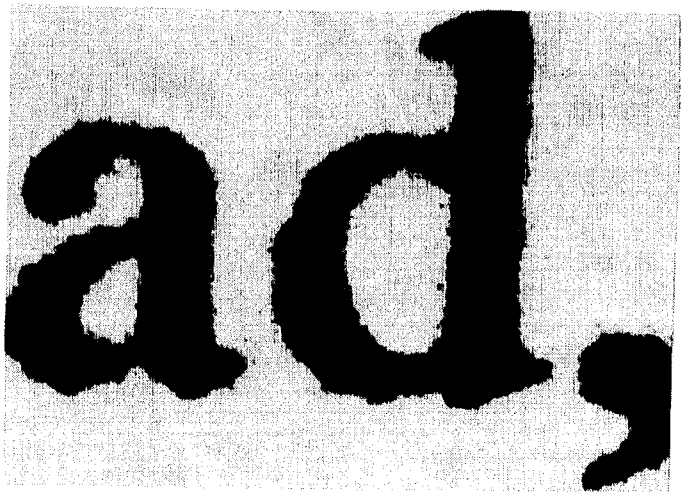
FIG. 9BB. PRIOR ART
FIGS. 9A and 9AA depict magnified characters printed using the techniques of the present invention and FIGS. 9B and 9BB depict similarly magnified characters printed by the IBM 4019 printer.
Figure 9A:
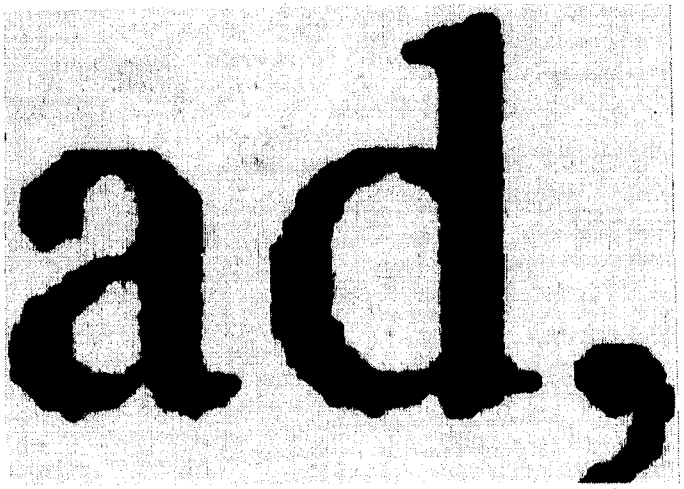
Figure 9B:
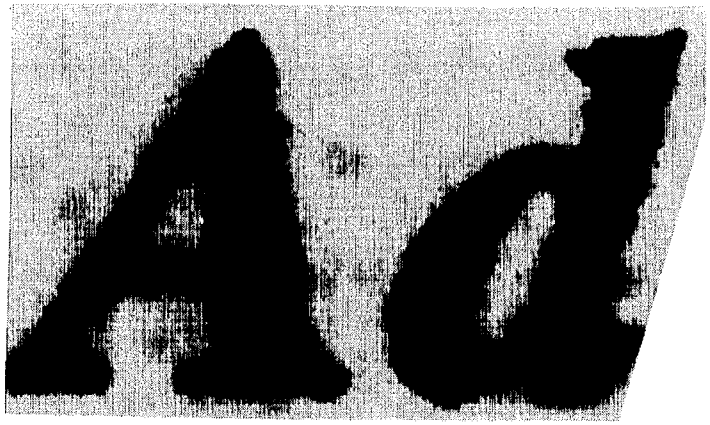
FIG. 9B. PRIOR ART
Figure 9A:
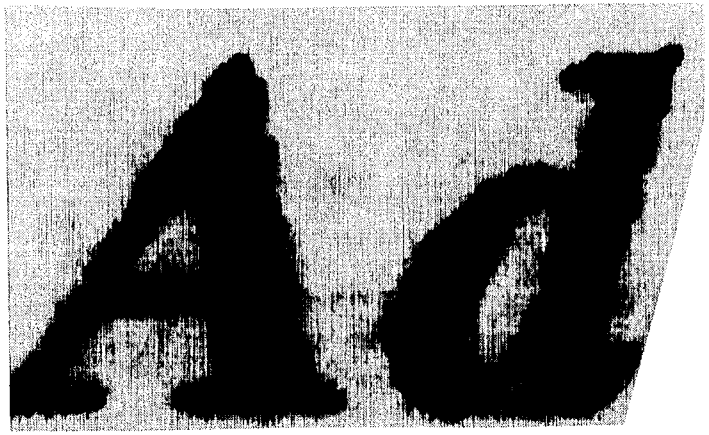

Shown in FIGS. 9A and 9AA are results according to the invention compared to FIGS. 9B and 9BB which are results provided by the IBM 4019 printer. FIGS. 9A, 9AA represent the level of quality with minimized background which can be achieved by application of the present invention. In this instance, the background was improved even over the results depicted in FIGS. 5A through 8AA by the use of corrected experimental procedures.

The present invention also provides an electrophotographic engine for multi-color application that maintains the high quality edges already described. In this instance, pressure transfer is suggested to an intermediate surface at which the various color toner images are accumulated and then thermally transferred to paper. Accumulation is necessary because the physical size of the paper will change after each thermal transfer, among other reasons. In this instance, the intermediate surface must have a circumference at least the size of a sheet of paper so that image accumulation is possible.

Figure 10A:
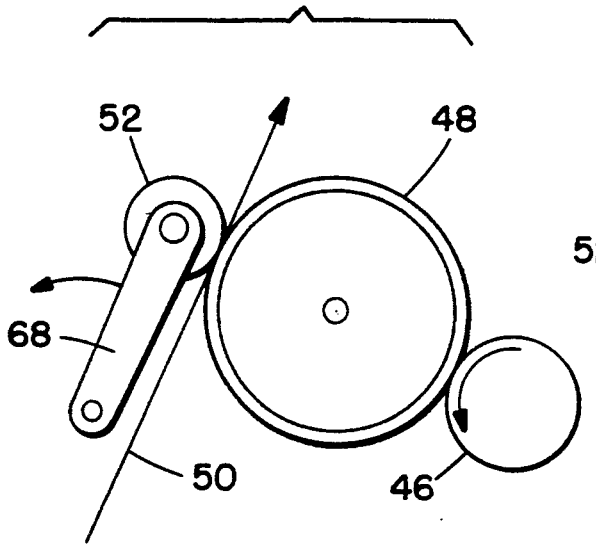
FIGS. 10A and 10B diagrammatically illustrate, respectively, two configurations of components for achieving multi-color images using the techniques of the invention.
Figure 10B:
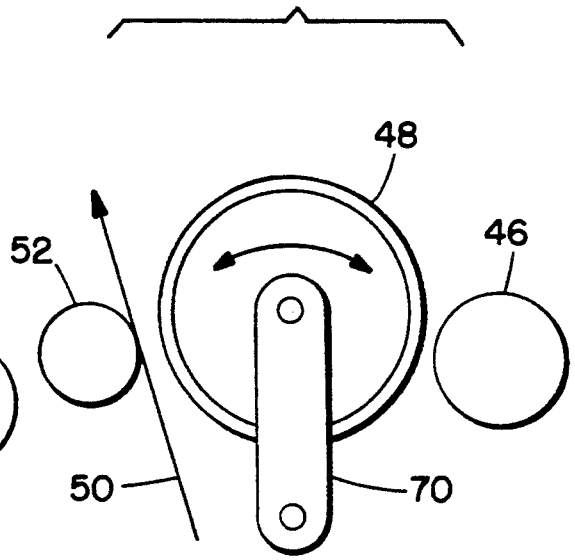

Viewing FIGS. 10A and 10B, two possible configurations which prevents the images being accumulated on the intermediate surface from being disturbed are shown. In FIG. 10A, on fuser roller 52 for thermal transfer is pivotally moved by means of a pivot arm 68 into and out of position against the accumulation surface on the intermediate drum 48 only when thermal transfer is initiated. In FIG. 10B, the surface on the intermediate drum 48, being rotatably supported on a pivot arm 70, is capable of being moved selectively against the photoreceptor 46 or the thermal fuser roller 52.

In the preceding disclosure, pressure transfer was first effected to an intermediate drum or belt and then thermal transfer to paper. The reason for the two transfer steps was to keep the photoreceptor from being exposed to the high temperatures required to fuse toner onto the receiving surface. While this is a concern for an organic photoreceptor and for amorphous selenium photoreceptors, it has been found that amorphous silicon photoreceptors can withstand temperatures of 200° C.

Figure 11A:
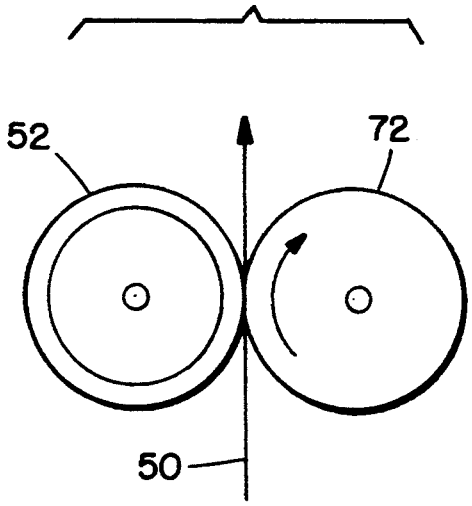
FIGS. 11A and 11B illustrate, diagrammatically, two different methods for imparting the image directly onto the receiving surface from a photoreceptor whose surface is composed of amorphous silicon.
Figure 11B:
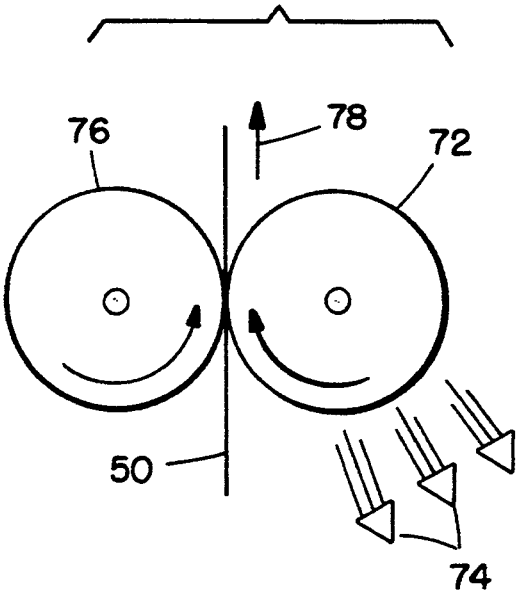

In FIG. 11A, a single thermal transfer can be achieved to the paper 50 from the surface of an amorphous silicon photoreceptor 72. The heat to accomplish the thermal fuse can be applied to either the back of the paper, as illustrated in FIG. 11B, or to the toner on the surface of the photoreceptor 72 from a suitable heat source, for example, quartz lamps 74. Heat from the quartz lamps 74 is applied to the surface of the photoreceptor 72 prior to the surface entering the transfer nip resulting from engagement of a pressure roll 76 against the photoreceptor thereby enabling controlled advancement of the paper 50 in the direction of an arrow 78. To prevent the toner in the development system from fusing to the photoreceptor 72, a monocomponent jump development system could be used or cooling of the appropriate components prior to development could be performed.

While the preferred embodiments of the invention have been disclosed in detail, it should be understood by those skilled in the art that various other modifications may be made to the illustrated embodiments without departing from the scope of the invention as described in the specification and defined in the appended claims.

We claim:

1. A method of producing electrophotographic characters on a receiving surface with minimal edge raggedness, the method comprising the steps of:

(a) producing a latent image on an image-receiving substrate;

(b) providing toner and charging the toner tribo-electrically;

(c) applying the tribo-electrically charged toner to the latent image on the image-receiving substrate and thereby developing the latent electrostatic image on the image-bearing substrate to create a developed image;

(d) transferring the developed image by other than electrostatic means to a receiving surface composed of a semi-conductive material having a resistivity of approximately $10^{10}$ ohm-cm or lower; and (e) selecting the toner so as to minimize the inclusion of wrong sign toner in the development system.

2. A method as set forth in claim 1 wherein step (b) includes the steps of:

(f) providing the toner in a carrier; and (g) selecting the toner and the carrier with sufficient uniform and different tribo-electric characteristics so as to minimize the inclusion of wrong sign toner in the development system.

3. A method as set forth in claim 1 including the step of:

(f) mixing magnetic material in to the toner in conjunction with placement of magnetic material in the development zone to thereby minimize the inclusion of wrong sign toner in the developed image.

4. A method as set forth in claim 1 wherein step (d) includes the step of:

(f) applying pressure between the image-bearing substrate and the receiving surface in the region of the latent electrostatic image to effect transfer thereof.

5. A method as set forth in claim 4 wherein the step (d) includes the step of:

(f) transferring the developed image onto an intermediate receiving surface of a rubber-like material having a roughness of approximately 0.5 μm and a hardness of approximately 37 shore A.

6. A method as set forth in claim 4 wherein step (d) includes the step of:

(g) transferring the developed image onto an intermediate receiving surface composed of an approximately ¼-inch thick member of nutrile rubber having on a surface thereof a coating of approximately 20 μm thickness of urethane.

7. A method as set forth in claim 4 wherein step (b) includes the steps of:

(g) mutually engaging the image-bearing substrate and the receiving surface in the region of the latent electrostatic image while (h) heating the receiving surface sufficiently to effect transfer of the image to the receiving surface.

8. A method as set forth in claim 7 including the step of:

(i) raising the temperature of the toner to approximately 10° C. above its glass transition temperature.

9. A method as set forth in claim 1 wherein (d) includes the steps of:

(f) transferring the developed image to an intermediate drum; and (g) then transferring the latent electrostatic image from the intermediate drum to a final receiving surface.

10. A method as set forth in claim 1 wherein step (d) includes the steps of:

(f) transferring the developed image to an intermediate belt; and (g) then transferring the latent electrostatic image from the intermediate belt to a final receiving surface.

11. A method as set forth in claim 1 wherein step (d) includes the steps of:

(f) transferring the developed image to an intermediate receiving surface; and (g) cooling the intermediate receiving surface.

12. A method as set forth in claim 1 wherein step (d) includes the step of:

(f) transferring the developed image onto paper.

13. A method as set forth in claim 1 wherein step (c) includes the steps of:

(f) developing the latent electrostatic image on an a-Si photoreceptor; and wherein step (d) includes the step of:

(g) transferring the developed image directly from the photoreceptor onto the receiving surface.

* * * * *